United States Patent [19]

Schmutzer et al.

[11] 3,943,356

[45] Mar. 9, 1976

[54] X-RAY TUBE ROTATING ANODE SENSING DETECTOR

[75] Inventors: Joel J. Schmutzer, Oak Park; John I. Klusendorf, Schaumberg; James J. Grichnik, Park Ridge, all of Ill.

[73] Assignee: Advanced Instrument Development, Inc., Melrose Park, Ill.

[22] Filed: Dec. 5, 1974

[21] Appl. No.: 529,734

[52] U.S. Cl. ..... 250/406; 250/416

[51] Int. Cl.[2] ..... H05G 1/70

[58] Field of Search ..... 250/401, 402, 406, 416; 313/60

[56] References Cited

UNITED STATES PATENTS 3,244,884 4/1966 McLaughlin ..... 250/406

*Primary Examiner*—Craig E. Church

*Attorney, Agent, or Firm*—Leo J. Aubel

[57] ABSTRACT

An apparatus for sensing the speed of a rotating anode of an X-ray tube and for providing signals responsive to the detected rotating speed.

10 Claims, 10 Drawing Figures

X-RAY TUBE ROTATING ANODE SENSING DETECTOR

BACKGROUND OF THE INVENTION

X-ray tubes having rotatable anodes or anode rotors are commonly and widely used in the X-ray field. The rotating anode provides a constantly changing target area for the generated X-rays so that the heat generated by the X-rays is more effectively dissipated. Such heat dissipation permits higher energy levels to be utilized thereby resulting in an increased X-ray current output as compared with tubes having a fixed anode.

In such rotating anode type of tubes, it is necessary to provide a means to assure that the anode has attained a selected rotational speed prior to the application of high voltage power to the anode and the subsequent generation of X-rays. Various prior art systems utilize time dependent apparatus for accelerating the anodes, and after a selected time initiating the X-ray exposure. In such prior art devices, a boost or acceleration signal is applied to the anode to start the anode rotating, and the generation of the X-rays and the bombardment of the anode is delayed for a fixed period of time to enable to anode to reach a selected rotational speed before the X-rays bombard on the anode. However, in boosting the speed of the anode to the desired speed, the prior art relies on boost power which is applied to the associated stator for a pre-selected fixed time and there is no other control to assure that the tube is actually rotating at the selected desired speed at the termination of the time period of the boost power.

Problems arise, since as a tube is used repeatedly, the associated mechanical and support assembly heats up and more resistance power is dissipated in the stator windings. As the tube housing gets hotter, the associated stator loses efficiency since its resistance goes higher, while the inductance remain fixed and causes more power to be dissipated in the form of heat in the windings and less power is transmitted to the anode rotor. Thus, it has been found that after the tube gets hot, most stators do not receive the required amount of energy to drive the anode to attain the desired running speed within the normal fixed boost time period.

Another problem of rotating anode tubes is the vibration caused by the mechanical resonance of the anode system. In presently available tubes, the mechanical resonance of the system is at approximately 6,000 RPM. Accordingly, it is desirable that the anode be accelerated and decelerated through this mechanical resonance point in a minimum of time to reduce any wear and damage caused by vibration as the anode speed goes through this point.

Another type of prior art comprises a mechanical vibrating reed tachometer. Frequently, the amplitude of mechanical vibrations of the rotating anode is not enough to excite the vibrating reeds at all running speeds. Tubes are normally designed to give minimum vibration at their desired operating speed, and it is extremely difficult to measure the vibration particularly at the low operating speeds.

Another type of prior art consists of a tachometer approach including a light which shines upon the rotating anode and a marker applied to the anode which reflects light at each revolution of the anode. The information is reflected to a light sensing device to develop an electrical signal, proportional to rotational speed of the anode. A disadvantage of this type of device is that markers must be placed on each anode; and, further, photo-optic circuits are often unreliable.

An important advantage of the inventive system is the provision of signals indicating selected rotating speeds of the anode for enabling control signals to be generated responsive thereto, to thereby control the acceleration and the deceleration of the anode rotor. More specifically, the inventive system senses vibrations of the mechanical housing of the rotating tube, translates that to a frequency related to the rotational speed and converts that into an electrical signal which is processed to provide a control signal.

The present invention conveniently obtains a signal from a position external to the tube. The present system thus does not require cutting into the electrical leads which supply power to the associated split phase motor which is used to drive the anode, and does not otherwise require any modification of presently available X-ray tubes.

An advantage of the inventive circuit is that it can be connected in the circuit or inter-locked to insure that the boost or accelerated signal continues to be applied until the tube is rotating at the desired speed before X-rays are directed to bombard the anode, thereby protecting the anode from destruction or damage. Also, the present circuit can assure not only that the tube is brought up to speed during the boost period, but also that the tube remains at that desired speed during the entire X-ray exposure period. For example, if the speed of the tube is reduced for any reason, such as by a mechanical lock-up or electrical power reduction, the present circuit would deactivate the X-ray sources.

During the boost periods when the X-ray starter is powered to accelerate the anode, the filament is brought up to high brightness, high current level in anticipation of the X-ray exposures. The longer the time required to boost the tube to the proper operating speed, the longer the filament must remain on high brightness condition. Thus, another advantage is that the circuit provides a signal such that the filament can be energized to a high brightness condition only for the time period required; the foregoing tends to extend filament life.

Another advantage of the present invention is that by putting the inventive circuit as a feedback control, the amount of boost time required on every exposure is reduced. For instance, if the tube is coasting at 2,500 RPM and a boost signal is provided, a minimal boost period is required to accelerate the tube to the selected speed, say 3,000 RPM, to prepare it for X-ray exposure.

Another important advantage of the present circuit is that a tube should decelerate rapidly from 9,000 RPM to a point below 6,000 RPM to minimize the effects of the tremendous vibration which results at the mechanical resonance of the tube which is at about 6,000 RPM. Normally, the anode is accelerated to a high speed, and after X-ray exposure, the anode is braked for a preselected fixed time to decelerate the anode quickly through 6,000 RPM point so as to minimize vibration damage to the filament and associated structure.

The present circuit will assure that braking is done properly and that the anode does not coast down through the damaging mechanical resonance point.

The foregoing and other objects, features and advantages of the invention will be apparent from the following more particular description of preferred embodiments of the invention as illustrated in the accompanying drawings wherein:

DESCRIPTION OF THE INVENTION

Figure 1:
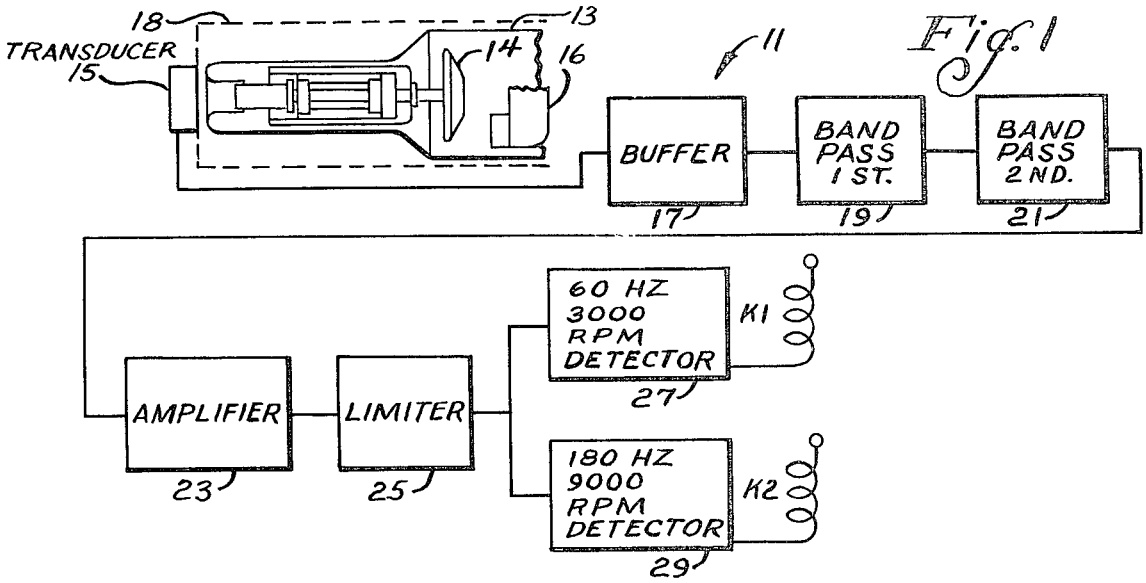
FIG. 1 is a block diagram of one embodiment of the inventive system.

FIG. 1 is a block diagram, generally labeled 11, of the inventive system indicating its use to monitor the speed of rotation of the rotatable anode of an X-ray tube 13. FIG. 1 shows a portion of the X-ray tube 13 including the rotatable anode 14 and an X-ray generator 16.

A vibration transducer 15 is mounted on the housing 18 for the X-ray tube 13. Vibration transducer 15 is a commercially available piezoelectric crystal transducer.

As is well known, when the crystal is stressed such as a result of mechanical vibrations, the crystal generates an electrical signal. It is the purpose of the transducer to sense mechanical vibrations responsive to anode rotation.

To insure that the transducer is sensing rotation of the anode, the transducer is mounted on an axis perpendicular to the axis of the rotor. This also tends to reject noise, or undesired signals from other sources, since it has been found that the mounting of the X-ray tube, the positioning of the tube, attitude of the tube, type of accessories attached to the tube, all affect the overall vibration on the tube housing.

The electrical signal from the transducer is coupled to a buffer or interface stage 17 comprising a source follower amplifier of any suitable known design. Buffer 17 has a high input impedance to minimize any electrical loading of the transducer 15.

The output of the buffer 17 is coupled to a first band pass or tuned resonant stage 19 which is tuned to resonance at about 170 Hz. Band pass stage 19 is coupled to series to a second band pass stage 21 which is tuned to resonance at 60 Hz. Band pass stages 19 and 21 comprise one form of frequency shaping circuits, and this operation will be described more fully hereinbelow with reference to FIGS. 3, 4 and 5.

The combined output of the band pass stages 19 and 21 is coupled to a variable gain amplifier 23 and thence to a limiter circuit 25 which limits the amplitude of the output voltage to thereby insure an output which is only frequency sensitive.

The output of the limiter 25 is connected in parallel to the 60 Hz or 3,000 RPM detector 27 and to the 170 Hz or 9,000 RPM detector 29. Detectors 27 and 29 also comprise tuned circuits which are tuned to peak at the frequency representative of the mechanical vibrations at the indicated RPM of the anode. In response to the indicated frequencies, the detectors 27 and 29 energize respective delays K1 and K2 to provide a signal indicating that the tube anode is rotating respectively at 3,000 RPM or 9,000 RPM.

Figure 3:
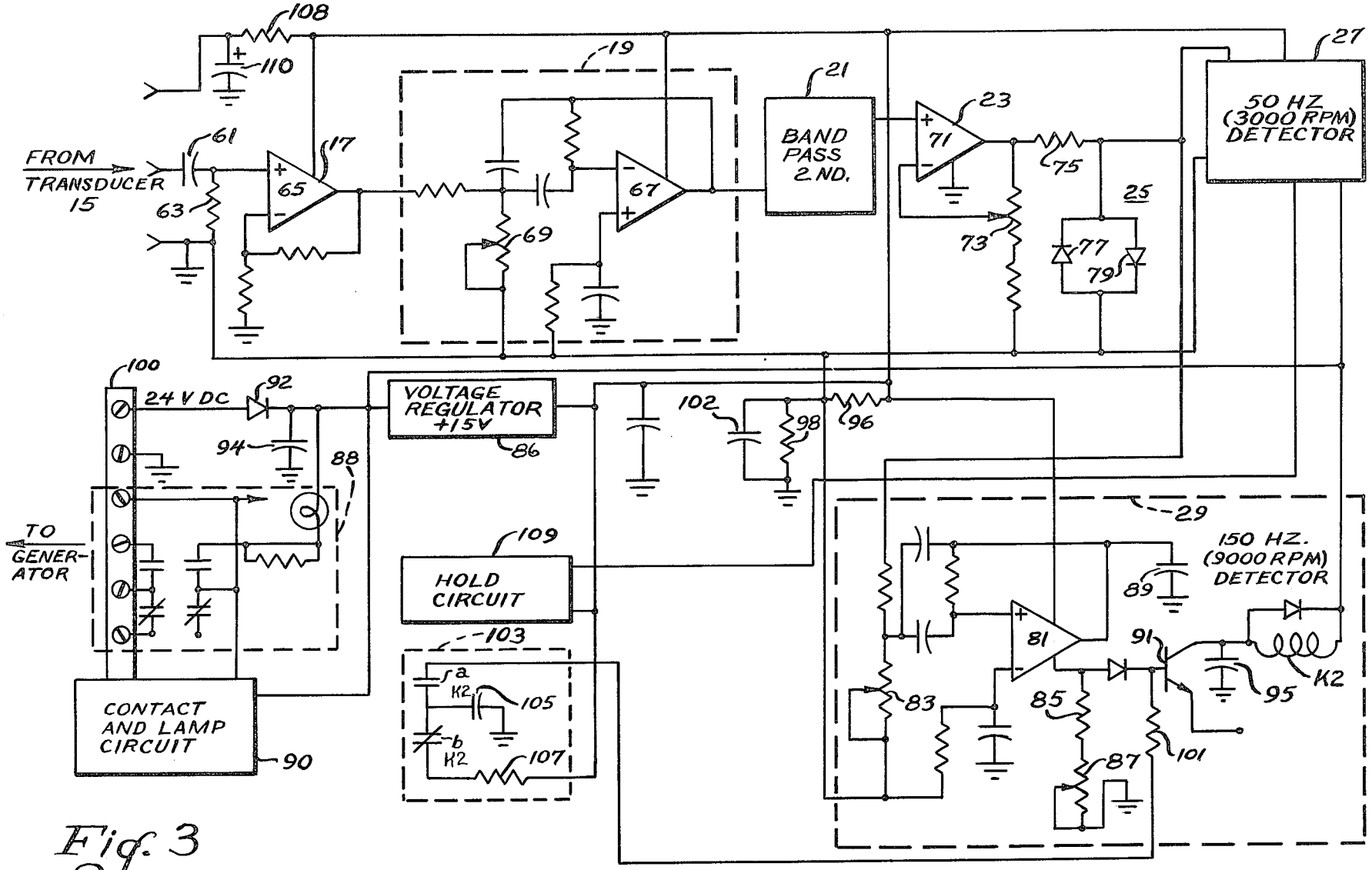
FIG. 3 is a schematic diagram based on the block diagram of FIG. 1.

Refer now to the schematic diagram of FIG. 3. An electrical signal from the transducer 15 representative of the vibration of the tube 13 is coupled through a capacitor 61 to the buffer stage 17 comprising an operational amplifier 65 of any suitable known design. A resistor 63 is connected from capacitor 61 and the input of amplitude 65 to ground. Capacitor 61 and resistor 63 provide a high pass filter which increases input impedance at low frequencies reducing the system response to frequencies below 40 Hz.

The signal from buffer 17 is coupled to a first band pass stage 19 comprising an operational amplifier 67 with a tuned parallel resonance circuit. Operational amplifier 67 is of any suitable known design and the stage 19 has an approximate gain of 6 and a sharpness of resonant factor or Q of two. The resonant frequency of band pass stage 19 is adjusted by variable resistor or potentiometer 69.

The output of band pass stage 19 is connected to band pass 21 which is essentially identical to band pass 19.

In one embodiment, band pass stage 19 is tuned to resonance at 170 Hz and band pass stage 21 is tuned to resonance at 60 Hz for purposes to be explained.

Figure 4:
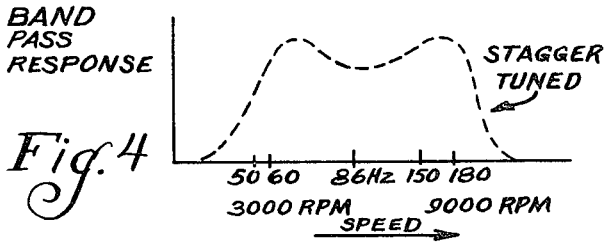
FIG. 4 shows the curves of the response of the band pass A and B of FIGS. 1 and 2.
Figure 5:
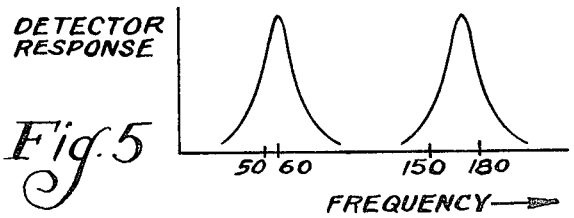
FIG. 5 shows the curves of the responses of the 3,000 RPM and 9,000 RPM detectors of FIGS. 1 and 2.

The stagger tuning of band pass stages 19 and 21 is an important feature of the invention. Referring to FIG. 4, and as stated above, the output of the two stages is combined and provides an output indicated by the dashed lines. As shown, stages 19 and 21 provide a maximum output at the two extreme points and a minimum output at approximately 86 Hz. This feature not only enables the selection of a low frequency representative of rotation of the tube anode at 3,000 RPM and of the high frequency representative of rotation of the tube anode at 9,000 RPM, but also enables the rejection of the undesired frequencies including the frequency of 120 Hz which results from the relatively large mechanical vibration of the stator coil which occurs during boost operations.

The output of band pass stages 19 and 21 are combined in series in a broad band adjustable gain non-inverting amplifier 23 whose gain is adjustable by variable resistor 73. The output amplifier 23 is then applied to a limiter 25 consisting of a series resistor 75 and parallel connected diodes 77 and diodes 79 which diodes are connected in relative inverse relation to each other. The limiter 25 limits the output to a pre-set amplitude level, in one embodiment the level being 0.7 volts.

Figure 6:
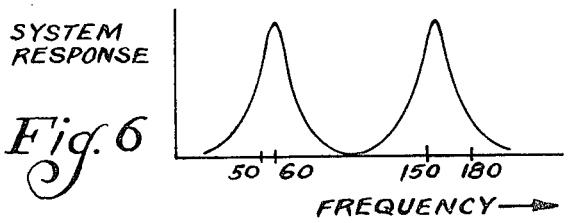
FIG. 6 shows a curve of the response of the system of FIGS. 1 and 3.

The output of the limiter 25 is then applied to both the 3,000 RPM rotation detector 27 and the 9,000 RPM rotation detector 29 in parallel. Detectors 27 and 29 are essentially identically tuned circuits with the associated capacitors being responsive to the frequency of 60 and 150 Hz, respectively, see also FIGS. 4, 5 and 6.

Referring to detector 29, it includes an operational amplifier 81 of any suitable known design and its circuit is tuned by adjustable resistor 83. The operational amplifier drives a capacitive load 89. The circuit reactive load impedance changes with the frequency, therefore, below resonant frequency, the circuit draws less current than it does above resonant frequency. The total current of amplifier 81 is sensed by means of connecting current sensing resistors 85 and 87 from the output of operational amplifier 81 to ground to measure the voltage drop across these combined resistors. At resonance, the amplifier 81 draws maximum current and the voltage across the two sensing resistors is at a maximum, that in turn, is used to turn on the transistor 91 to saturation to pass current through a relay coil K2 and energize the relay. A capacitor 95, connected from collector of transistor 91 to ground, filters out pulsations appearing at the output of the operational amplifier 81 and also delays the turn off of the relay K2 once it is pulled-in or energized.

An advantage of providing a capacitive load is that it gives a response which is not symetrical about the resonant frequency. A more selective skirt is provided for the lower edge of the resonant frequency which is exactly what is desired for descriminating against frequencies below 160 Hz or 150 Hz or 60 Hz and 150 Hz. In contrast, the conventional tuned circuit has equal response above and below the resonant frequency. The present circuit thus, has a relatively high rejection below the resonant frequency which enhances the operation of the device.

The center frequency of both band pass stages 19 and 21 can be tuned and the detectors 27 and 29 can also be tuned, as shown in FIG. 3, therefore, the circuit is a unit which can be conveniently adapted for almost any type tube and any power source frequency operation. The latter feature is suggested in FIG. 6; that is, the system response can be varied along the frequency axis. Thus, one of the advantages in providing for tuneable band pass stages and tuneable detectors is that in certain countries other than the U.S.A., operational power line frequencies may be 50 Hz and, therefore, the resonant frequency is 3,000 instead of 3,600 RPM and 9,000 RPM instead of 10,800 RPM. The system of the invention can thus be tuned to accomodate these power sources of different frequencies.

The contacts of the operation relays K1 and K2 and the associated lamp units indicated generally as 88 and 90 for the 3,000 RPM speed and the 9,000 RPM speed, respectively, are available at the mounting panel 100 to be connected to circuitry in the generator to inhibit or control exposures to that time wherein the target is at its desired operating speed. The lamp 88 when lit, indicates rotation of the anode at 3,000 RPM and lamp 90, when lit, indicates rotation of the anode at 9,000 RPM.

In the embodiment shown, the circuit is designed to operate from a 24 DC unregulated power. The 24 volts is coupled to a 15 volt regulator 86 whose output is used to provide a stable constant voltage to the electronic circuitry. A mid-voltage for providing the reference signal to the operational amplifiers in the circuit is established by dividing the 15 volts with the resistors 96 and 98 to a value of roughly 7½ volts which is filtered to ground by by-pass capacitor 102.

Resistor 108 and capacitor 110 establishes a low frequency signal by-pass, (upper left hand corner of FIG. 3).

A diode 92 is included in the circuit to prevent damage to the circuit should the 24 volt power supply to the input terminals be reversed.

The circuit includes hold-over circuits 103 and 109 for assuring that a momentary signal from the transducer during transient frequency condition or other mechanical impulses does not result in the relay momentary drop out. Such momentary drop out, could inhibit or terminate high current exposure resulting in damage to the generator or other associated such equipment. Since the target is of a considerable mass, even if a momentary interruption of the anode drive signal occurs, anode would continue to rotate and thus avoid any damage to the anode.

The hold-over or transient protection circuit 103 is connected to 9,000 RPM detector 29 through a series resistor 101, and the contact *a* of relay K2 and capacitor 105 to ground. When the relay K2 is in the normal off position, the capacitor 105 charges from the positive 15 volts applied through resistor 107, and the normally closed contacts *b* of relay K1. Once the relay K1 is pulled in, contacts *b* open and contacts *a* close and previously charged capacitors 105, is connected through a contact *a* to resistor 101 and the base of transistor 91. Should the signal to transistor 91 be momentarily interrupted, capacitor 105 provides power during the period of momentary interruption to drive transistor 91.

Hold-over circuit 109 is essentially identical to hold-over circuit 103.

Figure 7:
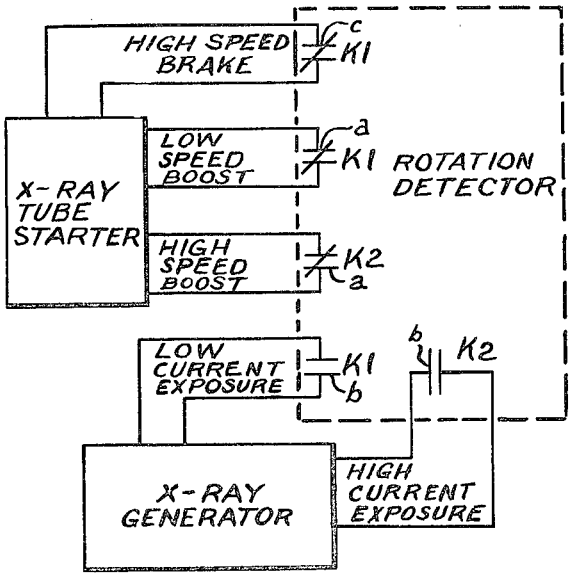
FIG. 7 is a block diagram showing an application of the invention in a closed loop control system.

FIG. 7 shows an X-ray tube control system including the rotation sensing detector of the present invention, an X-ray generator of any suitable known design, and an X-ray starter, which drives the tube, and which may be of the type disclosed and claimed in Reissue U.S. Pat. No. Re 28,618 and which is assigned to the same assignee as the present invention. Assume, it is desired to obtain an exposure with X-rays at the low current level. When activated, the rotation detector will allow the X-ray starter to apply low speed boost power through contact *a* of the relay K1 to accelerate the tube anode until the 3,000 RPM speed is attained at which time relay K1 will be energized opening contact *a* to terminate the boost signal, and concurrently contact *b* of relay K1 will interlock the X-ray generator allowing an exposure to be made.

Similarly, for high speed operation, the rotation detector controls the boost signal through relay K2 to insure the tube anode attains 9,000 RPM speed before X-ray exposure is initiated.

Also, when braking down from the high speed operation, the low speed relay K1 such as through contact *c* can be used to control the braking signal until the anode decelerates down to the 3,000 speed range at which time the brake cycle will terminate, and the tube can coast down to a stop or an additional signal can be applied thereto.

Figure 2:
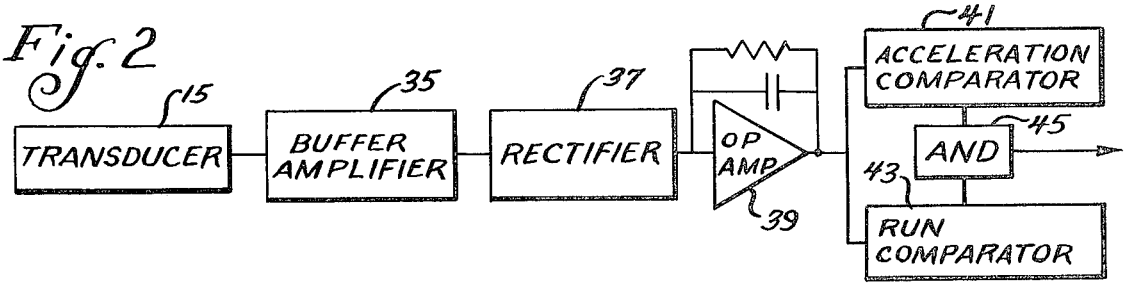
FIG. 2 is a block diagram of a second embodiment of the invention which may be useful in certain applications.

FIG. 2 shows another embodiment of the invention useful in certain applications. In the embodiment of FIG. 2, the signal from transducer 15 is coupled to the broad band amplifier 36 when the signal is amplified and then coupled to a rectifier 37 to rectify the signal. The rectified output from rectifier 37 is coupled to an operational amplifier 39. The output of the operational amplifier is coupled in parallel to an acceleration comparator 41 and to a run comparator 43, and the outputs from comparators 41 and 43 are then combined in a AND circuit 45. If the outputs from both comparators 41 and 43 are present, this will indicate a selected vibration plus a change in the rate of vibration to provide a valid acceleration-run sequence. The circuit of FIG. 2 is useful where noise signals, and signals other than those related directly to the speed of the anode can be ignored or are not a factor in obtaining speed indications.

It has been found that there is an optimum point on the tube and tube housing which will give a maximum vibration. It has also been found that vibration resulting in the two frequencies of interest tend to be obtained such as from two different positions on the end cap of the tube; that is, one position will result in a maximum vibration signal at 3,000 RPM: another position will result in maximum vibration signal at 9,000 RPM. Accordingly, a second vibration transducer may be placed on the end cap with each transducer being positioned to give a maximum output for the frequency of interest, and the outputs can be processed and then combined at the input of the detector circuits, (see also FIG. 8).

The circuit of the invention may include a disabling circuit for the rotation detector which opens up the current return lead from each of the relays K1 and K2 and the associated lamp circuits 88 and 90, thereby preventing any relays from being energized or pulled in as a result of any vibration when the tube is not operating, such as when it is being re-positioned for a subsequent examination. This prevents the relays from being pulled in from impulses applied to the transducer when the tube is not being used. It might be pointed out that although relays K1 and K2 are open at the time, the remainder of the circuit is On or operable.

Refer to the hold-over circuits 103 and 109. Other circuits utilizing the hysteresis effect wherein a high level is required to energize pull in the relay but a much lower level will allow it to drop out, have been found to operate substantially as satisfactory as hold-over circuits 103 and 109.

Figure 8:
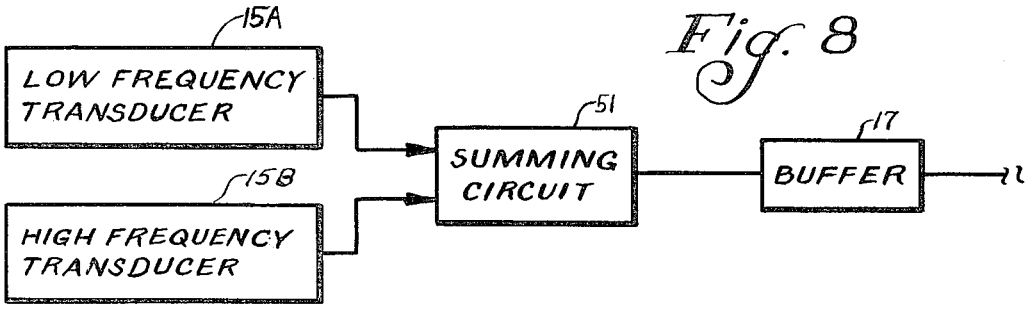
FIGS. 8 and 9 are block diagrams of other embodiments of the invention.

FIG. 8 shows a modification of the system of FIG. 1 wherein a low frequency transducer 15A is mounted on the tube housing. Transducer 15A is arranged to provide a maximum output at the lower frequency of interest, i.e. in the present embodiment, 50 Hz. A second transducer 15B is arranged to provide a maximum output at a relatively higher frequency, i.e. in this instance 150 Hz.

As mentioned above, it has been found that the transducer can be mounted on the tube housing at different positions to provide a maximum output at different frequencies. Thus, position of low frequency transducer 15A and of high frequency transducer 15B can be emperically determined to provide a maximum output from each of the transducers. The output of the two transducers can then be combined in a summing circuit 51 of any suitable known construction and then coupled to the buffer 17 and the rest of the circuitry of FIG. 1.

Figure 9:
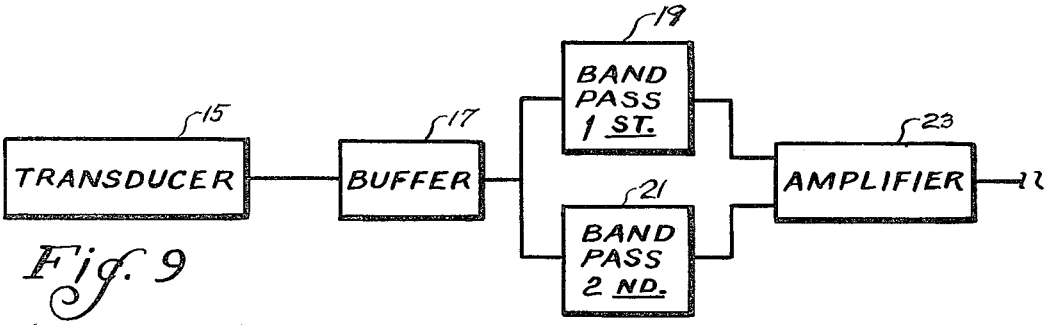

FIG. 9 shows a circuit which might be useful in certain applications. FIG. 9 shows the band pass stages 19 and 21 being connected to receive the signals in parallel and provide an output which is combined in amplifier 23. Note also that band pass stages 19 and 21 could comprise a low pass filter, a high pass filter to pass the frequencies of interest and a notch filter to reject the 120 Hz signal representative of the mechanical resonance vibration of the system, as discussed above.

Figure 10:
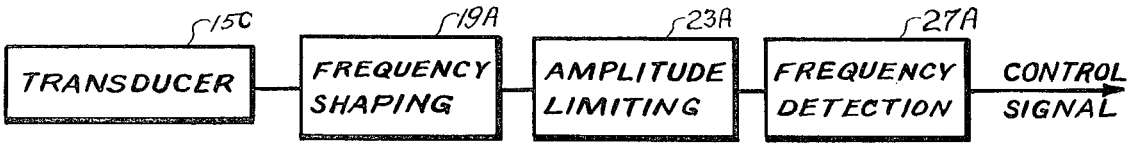
FIG. 10 shows a basic concept of the invention in block diagram form.

FIG. 10 shows a basic concept of the invention wherein the transducer 15C itself can provide a proper signal or inter-face directly with the frequency shaping circuit 19A of the system.

As mentioned hereinabove, the frequency shaping circuits can be suitable stages to provide maximum output at the selected frequencies and a minimum output at other frequencies. The output from the frequency shaping circuit is amplitude limited by any suitable circuitry 23A known in the art to provide an output which is only frequency sensitive and independent of any amplitude variations. The frequency detection circuit 27A detects the frequency of interest and provides a control signal in response thereto.

While the invention has been particularly shown and described with reference to preferred embodiments thereof, it will be understood by those skilled in the art that various changes in form and details may be made therein without departing from the spirit and scope of the invention.

What is claimed is:

1. A system for sensing the rotational speed of the rotatable anode of an X-ray tube, comprising, in combination, means for sensing the vibrations of the rotating anode, means for converting said vibrations into alternating current signals of different frequencies, means for selecting signals at a frequency responsive to a vibration depicting a given rotational speed of the anode, and means for providing an output indicative of the selected frequency and thereby of the given rotational speed of the anode.

2. A system as in claim 1 wherein said means for selecting a frequency comprises frequency shaping circuit means for providing a maximum level output at a frequency representative of selected rotational speeds of said anode, means for limiting the amplitude of the output of said frequency shaping circuit means, and detecting means tuned to a selected frequency representative of a selected rotational speed whereby the system provides signals representative only of the frequency associated with the vibration or imbalance of the rotatable anode rotating at selected rotational speeds.

3. A system as in claim 2 wherein said frequency shaping circuit comprises a first frequency band pass stage tuned to a first frequency to provide a maximum output at a first selected rotational speed of said anode, a second frequency band pass stage tuned to a second frequency to provide a maximum output at a second selected rotational speed of said anode, means for combining the outputs of said first and second band pass stages for providing maximum responses at the selected frequencies and a reduced response at frequencies therebetween, first and second frequency detectors arranged to respectively provide a maximum output in response to frequencies indicative of said first and second selected speeds respectively, and means for connecting said output to provide a control signal therefrom.

4. A system as in claim 3 wherein the output of said detectors is coupled to a capacitance load whereby the rejection of the signals adjacent the lower edge of the tube frequency is maximized.

5. A system as in claim 3 wherein said first and second band pass stages are tuned to provide maximum output at approximately 60 Hz and 150 Hz at selected frequencies and a minimum output at approximately 120 Hz.

6. A rotation detector as in claim 3 further including a plurality of transducers each positioned and arranged to selectively provide a maximum vibration indicative of a given rotational speed of the anode.

7. A system as in claim 3 further including a hold circuit comprising means for maintaining an output from each of said detectors through a momentarily loss of signal whereby transients and noises do not cut off the system.

8. A system as in claim 1 wherein said means for sensing the vibration of the tube comprises a transducer mounted externally of said tube.

9. A system as in claim 1 further including band pass stages connected in series and said detecting means are connected in parallel.

10. A system as in claim 1 wherein a single band pass stage is employed to select a single frequency and thereby select a single rotating speed.

* * * * *